US006739438B1

(12) United States Patent
León-Rovira et al.

(10) Patent No.: US 6,739,438 B1
(45) Date of Patent: May 25, 2004

(54) BRAKE RIGGING SYSTEM

(75) Inventors: Noel León-Rovira, San Pedro Garza Garcia (MX); Rodrigo Ruizpalacios-Remus, Monterrey (MX); Oscar Martínez-Romero, Monterrey (MX); Edson-Francisco García-Moreno, Monterrey (MX)

(73) Assignee: Acertek, S.A. de C.V., Nuevo Leon (MX)

( * ) Notice: Subject to any disclaimer, the term of this patent is extended or adjusted under 35 U.S.C. 154(b) by 0 days.

(21) Appl. No.: 09/650,453

(22) Filed: Aug. 29, 2000

(51) Int. Cl.[7] ..... B61H 13/36
(52) U.S. Cl. ..... 188/219.1; 188/222; 188/207
(58) Field of Search ..... 188/229.1, 229.6, 188/219.1, 219.6, 220.1, 222, 207, 222.1, 222.6

(56) References Cited

U.S. PATENT DOCUMENTS 4,193,480 A * 3/1980 Malo ..... 188/52
4,613,016 A * 9/1986 Hart et al. ..... 188/52
4,795,007 A * 1/1989 Murphy et al. ..... 188/207
4,830,148 A * 5/1989 Hart et al. ..... 188/52
5,901,819 A * 5/1999 Engle ..... 188/219.1
6,148,966 A * 11/2000 Daugherty, Jr. et al. ..... 188/52
6,234,283 B1 * 5/2001 Montes-Ramos ..... 188/219.1

* cited by examiner

*Primary Examiner*—Jack Lavinder
*Assistant Examiner*—Xuan Lan Nguyen
(74) *Attorney, Agent, or Firm*—Abelman, Frayne & Schwab

(57) ABSTRACT

A brake rigging system which adequately distributes the braking force among all its components, said brake rigging system comprising: a driving beam having a first and a second end; two driving levers having a first and a second end, each driving lever rotary coupled by its first end to an end of the driving beam, and the second end of each driving lever coupled to a brake head; and linking means for linking said driving beam, to driving means which apply a force to said driving beam to push or pull said driving levers together with the brake heads.

15 Claims, 4 Drawing Sheets

BRAKE RIGGING SYSTEM

BACKGROUND OF THE INVENTION

A. Field of the Invention

This invention relates to a brake rigging system, and more particularly to a brake rigging system which achieves an adequate brake force distribution among all its elements including the brake heads.

B. Description of the Related Art

Most railroad freight cars, use what is known as foundation brake rigging. On the car body, there is an air brake system which provides air to the brake cylinder, which, in turn, supplies a mechanical force, through a system of rods and driving levers to a connection on the standard freight car trucks located at each end of the car. At this point, the force is applied to a truck driving lever system, usually consisting of two driving levers and a connecting rod. The driving levers move brake beams which apply force to the treads of the wheels through renewable friction blocks or brake shoes, retarding the rotation of the wheels.

The conventional brake rigging includes two brake beams, at least one brake cylinder assembly supported by one or both of the brake beams, and a driving lever or linkage assembly so connected between the brake beams and cylinder assembly that actuation of the cylinder assembly moves the brake beams away from one another and into braking engagement with treads of wheels of a railway vehicle truck. U.S. Pat. Nos. 2,996,963 and 3,107,754 each describe an example of such a brake rigging. Commonly, however, a conventional brake rigging is relatively heavy and is therefore responsible for a significant fraction of the power required to move its vehicle truck along railway tracks.

The brake rigging may be "truck mounted" i.e. every truck of the railway car has its own braking mechanism with independent driving means.

There are many brake beams configurations used with the above referred general type of brake rigging, but the most common type of brake beam which is the most commonly used, comprises a compression member, a generally "V" shaped tension member having its ends coupled to the ends of the compression member, a brake head linked to the each end of the compression member, two end extensions, each linked at each end of the tension and compression member, by which the brake beam is coupled to the bogie of a railway car and a fulcrum welded to the compression member and tension member, so that the fulcrum remains between the tension and compression members.

The main problem of the above described brake rigging system—including the above referred brake beam—, is the inadequate distribution of the braking force among the two brake shoes due to the configuration of the brake beam, principally due to the inclination of the fulcrum of the brake beam, through which the driving lever passes.

During use, high torsional moments are induced over the brake beam by the brake rigging, and furthermore, the braking force applied to the fulcrum by the driving lever is not equally distributed along the whole beam, causing a great stress in certain parts and elements,of the brake beam when brakes are applied. These harmful forces are especially high at the ends of the brake beam which is the point where the brake beam is coupled to the bogie and where several components thereof are joined, such as the brake head, the tension member and compression member, therefore the ends of the brake beam become critical points where a lot of harmful forces converge.

This inadequate distribution of forces cause an inadequate distribution of the braking force among the brake shoes and thus different deceleration rates among the wheels of the freight car, making it necessary to apply more pressure to the brake shoes in order to compensate for the wheels having a deficient braking, causing overheating and thermal damage to those wheels.

Moreover, the inadequate orientation that the brake beam keeps with respect to an horizontal axis and consequently, the ineficient actuation of the brake beam over the wheels, produces a nonuniform and incomplete wear of the useful material of the brake shoes, which causes a waste of brake shoe material that could be properly used.

The above referred problem forces the maintenance team to frequently change the brake shoe material which is a waste of time and money.

Another important problem related to the inadequate force distribution among the brake shoes, is the misalignment caused to the wheels when the brakes are applied.

Considering the above referred problems, applicants developed a brake rigging system which adequately distributes the braking force among all its components, thus eliminating all the above related problems.

Applicants brake rigging system comprises: a driving beam having a first and a second end; two driving levers having a first and a second end, each driving lever rotary coupled by its first end to an end of the driving beam, and the second end of each driving lever coupled to a brake head; and linking means for linking said driving beam, to driving means which apply a force to said driving beam to push or pull said driving levers together with the brake heads.

The driving levers can be linked to the brake heads by means of two torsional elements, which can be rotary coupled to an end of a support beam and each linked at and end of one of the driving levers of the brake rigging system; two brake head levers tightly coupled to the torsional elements and each joining a brake head; and two pivot extensions to be coupled to the bogie of a railway car, each tightly coupled to each torsional bar in order to pivotally join the brake beam to the bogie of a railway car.

Also the brake heads may be directly coupled at a central portion of each driving lever, thus eliminating the torsional bars.

Applicants brake rigging system produces a pivotal movement of the brake beam, achieving an uniform force distribution among the whole brake beam and between each brake shoe, eliminating the non-uniform braking among the wheels and the resulting wheel damage.

Additionally, the new brake rigging of the present invention, allows a good adaptation of the brake shoes to the wheel contour, achieving a uniform contact between the brake shoe and the wheels, by which all the useful material in the brake shoe is totally used, eliminating points in the brake shoe where the material is so worn that the metal of the brake shoe head comes in direct contact with the wheel.

Due to the adequate use of all the material of the brake shoe, and to the elimination of the wheel damage, the need for frequent change of the brake shoes and wheels avoided, which helps to achieve great money saving in view of the high maintenance costs caused by said frequent changes, and avoids the waste of useful brake shoe material that still could be used if the thickness of the remaining material were uniform.

And last but not least, the brake rigging system extends the brake beam operative life due to the adequate distributions of force to all the elements of the brake beam, which eliminates stress points which could cause the brake beam to break or collapse.

SUMMARY OF THE INVENTION

It is therefore a main object of the present invention, to provide a brake rigging system which adequately distributes the braking force among the whole brake beam It is also a main object of the present invention to provide a brake rigging system, by which uniform wear of the useful material of the brake shoes achieved.

It is another object of the present invention to provide a brake rigging system by which damage to the wheels of the railway car, produced by an inadequate distribution of the braking force applied to the wheels by the brake shoes through the brake beam is reduced.

It is also a main object of the present invention to provide a brake rigging system which extends the brake beam operative life due to the adequate distribution of force to all the elements of the brake beam, which eliminates stress points which could cause the brake beam to break or collapse.

It is also another object of the present invention to provide a brake rigging system which helps to achieve great money saving in view of the high maintenance costs caused by the frequent changes of the brake shoe material.

These and other object and advantages of the brake rigging system of the present invention will become apparent to those persons having an ordinary skill in the art, from the following detailed description of the embodiments of the invention which will be made with reference to the accompanying drawings.

DETAILED DESCRIPTION OF THE INVENTION

Figure 1:
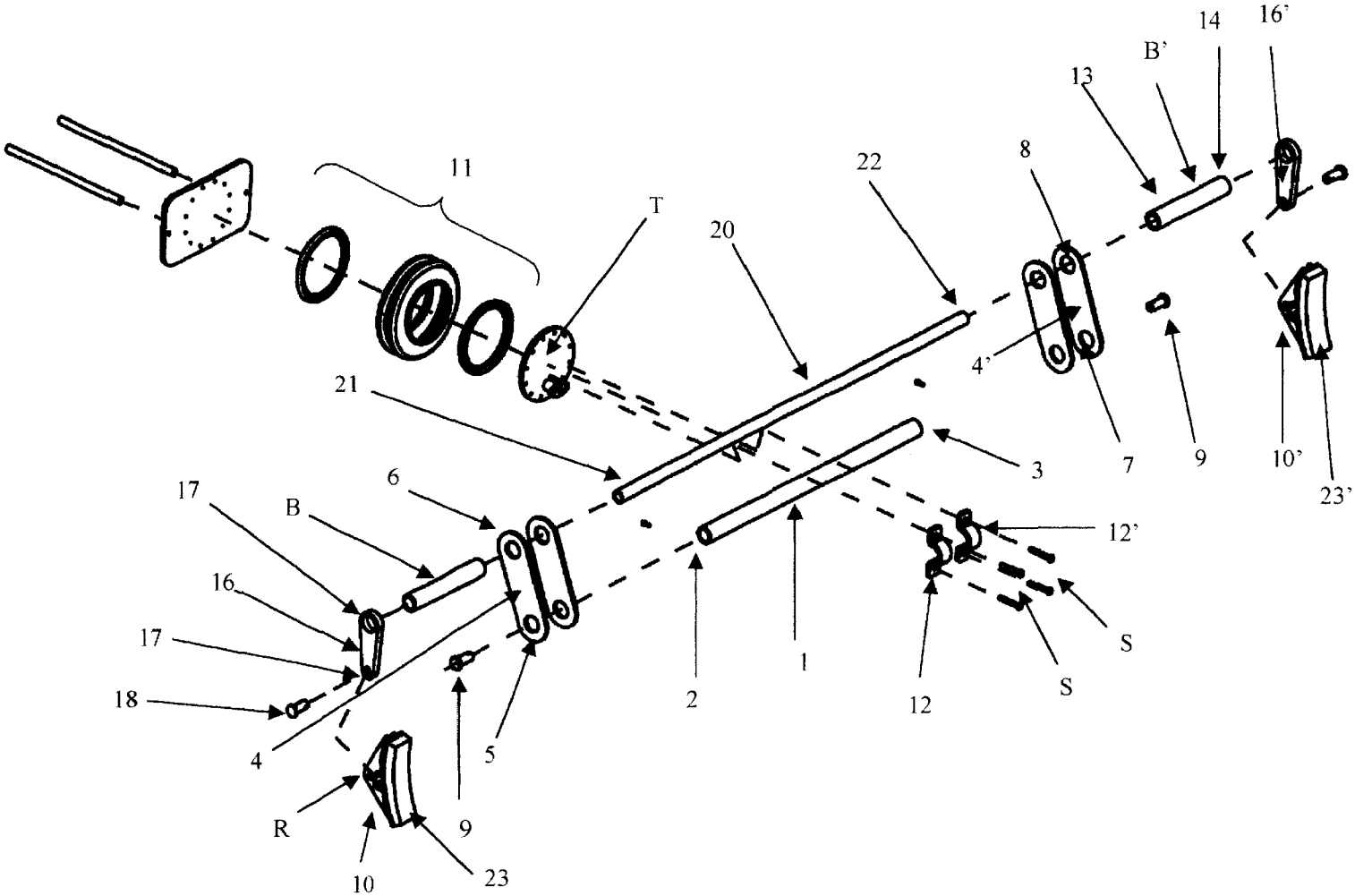
FIG. 1 is an exploded view of the first embodiment of the brake rigging system of the present invention linked to driving means.
Figure 2:
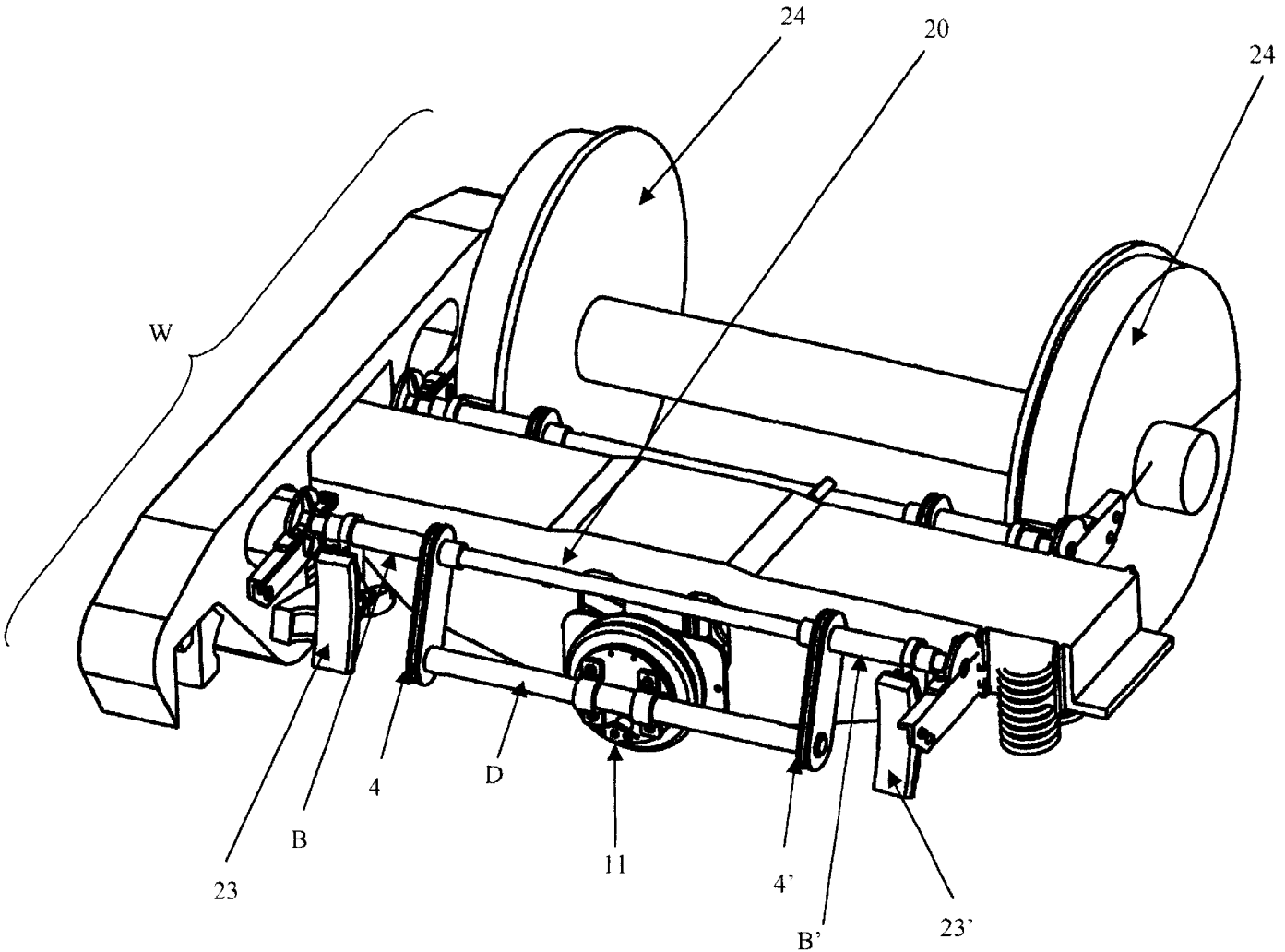
FIG. 2 is a perspective view of a railway car bogie, having the brake rigging system of the present invention in accordance with a first embodiment thereof.

The brake rigging system of the present invention, will now be described in accordance with its most general embodiment thereof, illustrated in the accompanying drawings wherein the same signs and numbers, refer to the same parts of the shown figures, same parts of the shown figures. The brake rigging system of the present invention comprises:

a driving beam (1) comprised by a hollow tubular member having a first (2) and a second (3) open ends;

two pairs of driving levers (4,4') each comprising an elongated and planar member including a first (5) and a second (6) rounded ends and including a first (7) and a second perforation (8), each driving lever rotary coupled to an end of the driving beam (1) by means of a bolt (9) passing through the first perforation (7) of the driving lever and housed inside the first open end (2) of the driving beam, and each driving lever (4,4') linked to a brake head (10,10');

linking means for linking said driving beam (1), to driving means (11) which apply a force to said driving beam (1) thus pushing or pulling said driving levers (4,4'), comprising one or more clasps (12, 12') joining the driving beam (1) to driving means (11) preferably comprising a pneumatic cylinder. In this case the clasps (12,12') join the driving beam (1) to the pneumatic cylinder top (T) by means of two or more bolts (S).

In a first embodiment of the present invention, each driving lever (4,4') may be linked to each brake head (10,10') by means of:

two torsional bars (B, B'), each comprising a hollow tubular member having a first (13) and a second (14) open ends and the first end (13) of each torsional bar (B,B') passing through the second perforation (8) of each driving lever (4,4'), and tightly retained thereof.

two brake head levers (16, 16') each including a first and a second perforation (17, 17'), said first perforation (17) tightly coupled to the second end (14) of the torsional bar (B,B'), and each brake head lever (16, 16') coupling a brake head (10,10') by means of a bolt (18) passing through the second perforation (17') of the brake head lever (16, 16') and trough a perforation (R) on the brake head (10, 10').

Each torsional bar (B,B') is be linked to a support beam (20) comprising a hollow tubular member having a first (21) and a second (22) end, said support beam (20) having a diameter slightly lesser than the diameter of each torsional bar (B,B') in order to completely pass through each torsional bar and be pivotally coupled to the bogie of a railway car;

As it was previously described, the driving means (11) is a pneumatic actuator, —preferably a flexible. rubber pneumatic cylinder and preferably one pneumatic actuator by each pair of brake heads—, which applies a force to the driving levers (4,4') by the driving beam (1) in order to produce a pivotal movement of the torsional bars (B,B') which push the brake shoes (23, 23') against the bogie wheels (24) and achieving an adequate contact between the brake shoes (23, 23') and the bogie wheels (24).

Although each torsional bar (B,B') may be joined to each driving lever (4,4') of the brake rigging by pressure in order to avoid the rotation between each other when a force is applied to the driving levers (4,4'), the torsional bars (B,B') and the second perforation (8) of each driving lever (4,4') may have any shaped cross section in order to prevent the rotation between each other.

In a second embodiment of the present invention, the brake rigging of the present invention lacks the torsional bars (B,B') and the brake head levers (16,16').

Figure 3:
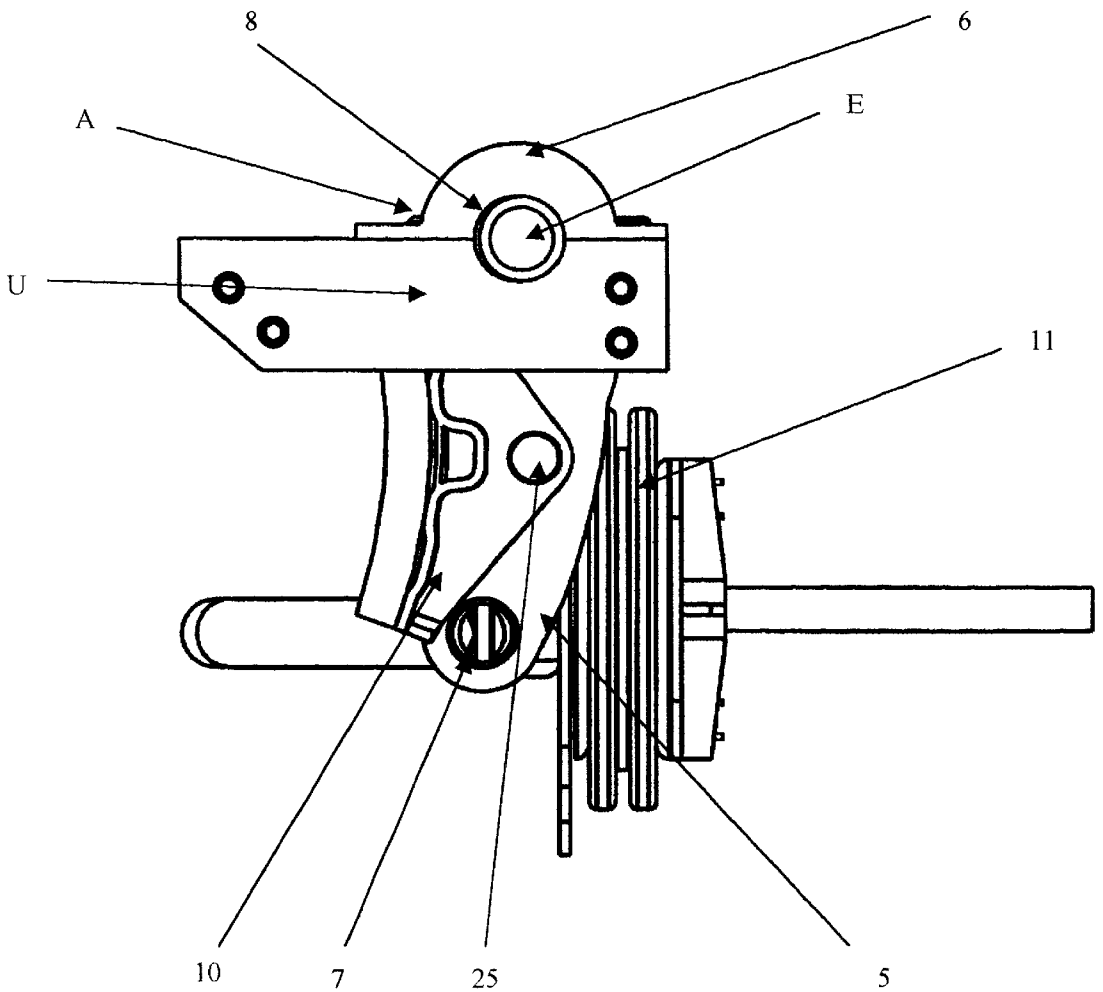
FIG. 3 is a perspective view of the second embodiment of the brake rigging system of the present invention.
Figure 4:
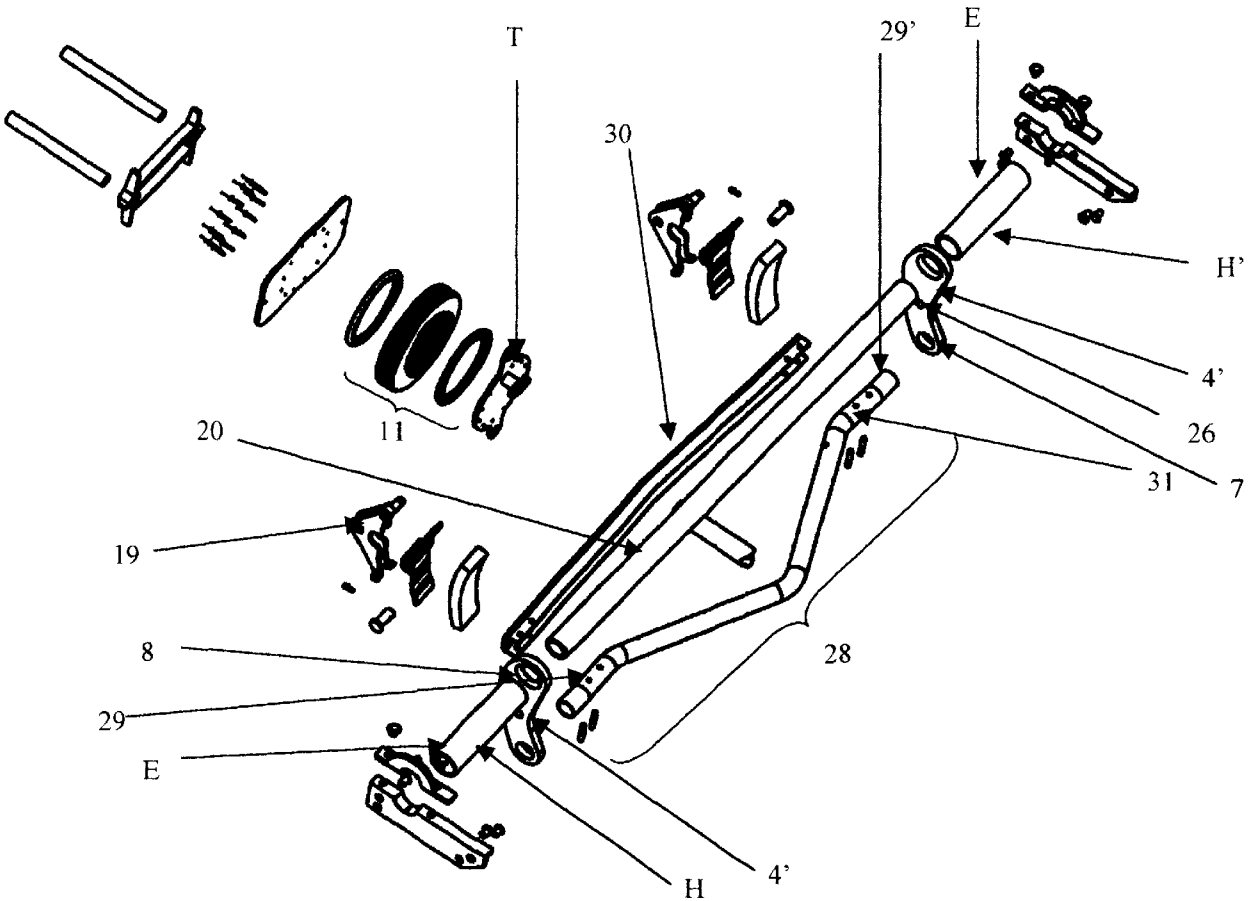
FIG. 4 is a perspective view of the third embodiment of the brake rigging system of the present invention.

In the second embodiment, the brake heads (10,10') are directly linked to a central portion of each driving lever (4,4') as shown in FIG. 3 by means of a bolt (25) passing through a third perforation (not shown) located at a central portion of each driving lever (4,4') and through a perforation on the brake head (10,10'), and each driving lever (4,4') is linked to the bogie frame by means of a pivot extension (E) passing trough the second perforation (8, only position indicated) and is rotary retained by retaining means located at the bogie frame, said retaining means comprising a clasp (A) and a support (U) linked to the bogie frame (W). In order to prevent that the brake head make contact with the pivot extension, the second end (6) of each driving lever is wider than the first end (5), and the second perforation (8, only position indicated) is located in a position slightly behind the first perforation (7, only position indicated), thus the pivot extension remains behind the brake head.

In a third embodiment of the present invention, the driving beam (1) is be substituted by a truss type brake beam (28).

In the third embodiment, each end (29,29') of the tension member (31) is rotary coupled to the first perforation (7) of each driving lever (4,4') (having the same characteristics of the driving levers of the second embodiment) (4,4'), and the compression member (30) is directly coupled to driving means (11) at a central portion thereof, said driving means (11) comprising a pneumatic cylinder. Thus the compression member (31) is directly linked to the top (T) of the pneumatic cylinder. Each driving lever (4,4') is linked to the bogie of the railway car by means of a support pivot in the form of a bushing element (H,H') comprising a hollow tubular member having a first and a second end (E,E'), said bushing element passing through the second perforation (8) of each driving lever (4,4') and retained thereof near the second end of the bushing element (H,H'). In this embodiment the support beam (20) is maintained, and is tightly retained inside the first end (E) of each bushing element (H,H'), and each brake head (10,10') is directly and rotary linked to each driving lever (4,4') at a central portion thereof by means of a bolt (not shown) passing through a third perforation (26) and through a perforation on the brake head (19) (as described in the second modality of the present invention).

Thus, when the driving means (11) apply a force on the driving beam (1)—or on the truss type brake beam (28) in accordance with a third embodiment of the present invention—, a pivotal movement of the driving levers (4,4') which push the brake heads (10,10') against the wheels is produced (24), by which adequate distribution of the braking force among the brake heads (10,10') and an adequate contact between the brake shoe (23, 23') and the wheels is achieved (24), thus increasing the operational life of the whole brake rigging.

Finally it must be understood that the brake rigging system of the present invention, is not limited exclusively to the above described and illustrated embodiments and that the persons having ordinary skill in the art can, with the teaching provided by this invention, to make modifications to the design and component distribution of the brake rigging system of the present invention, which will clearly be within the true inventive concept and scope of the invention which is claimed in the following claims.

What is claimed is:

1. A brake rigging for a railway car, the brake rigging comprising:

two support points for mounting the brake rigging to a bogie of the railway car;

a driving beam;

two driving levers, each lever having first and second ends, wherein the first end of one driving lever is connected to the driving beam at a first location, the first end of the other driving lever is connected to the driving beam at a second location spaced from the first location, and the second end of each driving lever is connected for rotation relative to the bogie of the railway car at one of the support points;

a pair of brake heads, each of which is mounted to one of the driving levers; and a drive mechanism for applying a force to the driving beam to rotate the driving levers relative to the support pivots, the driving beam being pushed by the drive mechanism to cause the brake heads to apply a braking force to the railway car and pulled by the drive mechanism to release the braking force applied by the brake heads to the railway car.

2. The brake rigging according to claim 1, wherein the driving beam is a hollow tubular member having open first and second ends.

3. The brake rigging according to claim 1, wherein each driving lever is an elongated and planar member, having first and second rounded ends, with a perforation at each end.

4. The brake rigging according to claim 1, wherein the driving beam is a hollow tubular member having open first and second ends, and each driving lever comprises a pair of elongated and planar driving lever members having first and second rounded ends with a perforation at each end, each pair of driving lever members being rotary coupled to an end of the driving beam by a fastener passing through the perforation at the first end of each driving lever member and secured inside an open end of the driving beam.

5. The brake rigging according to claim 1, wherein the drive mechanism includes a pneumatic cylinder.

6. The brake rigging according to claim 5, wherein the pneumatic cylinder is secured to the driving beam by at least one clasp joined to a top of the pneumatic cylinder by a plurality of fasteners.

7. The brake rigging according to claim 1, wherein each driving lever comprises a pair of driving lever members linked to a corresponding brake head by (i) a torsional bar mounted for rotation relative to the bogie of the railway car at one of the support points and including a hollow tubular member having first and second open ends such that the first end of each torsional bar passes through a perforation of each one of the corresponding pair of driving lever members and is tightly secured thereto, and (ii) an elongate, planar brake head lever having first and second opposite ends, each brake head lever being tightly coupled at its first end to the second end of a corresponding torsional bar, and rotary coupled at its second end to a brake head by a fastener through a perforation at the second end of the brake head lever and a perforation of the brake head.

8. The brake rigging according to claim 7, further comprising a hollow tubular support member having first and second ends and a diameter less than the diameter of the torsional bars in order to pass through the torsional bars for rotation relative thereto, wherein each of said first and second ends of said support member is mounted to the bogie of the railway car at one of the support points.

9. The brake rigging according to claim 7, wherein each torsional bar is joined under pressure to a corresponding pair of driving lever members in order to preclude rotation between the torsional bar and the brake lever members.

10. The brake rigging according to claim 7, wherein the torsional bars and a perforation at the second end of each driving lever member have a cross sectional area in a shape that prevents rotation between the torsional bars and the brake lever members.

11. The brake rigging according to claim 1, wherein each brake head is directly linked to a central portion of each driving lever by a fastener passing through a perforation located at a central portion intermediate the first and second ends of each driving lever and through a perforation on the brake head.

12. The brake rigging according to claim 1, wherein the driving beam is a truss type brake beam, having a tension member and a compression member, each member having a pair of opposite ends, such that one end of the tension member is respectively rotary coupled to a perforation at the first end of each driving lever and the compression member is directly coupled to the drive mechanism at a central portion of the compression member.

13. The brake rigging according to claim 12, wherein the drive mechanism is a pneumatic cylinder and the compression member is directly linked to a top of the pneumatic cylinder.

14. The brake rigging according to claim 12, wherein the second end of each driving lever is wider than the first end, and a perforation at the second end of each driving lever mounting the driving lever to the support pivot is located in a position behind the perforation at the first end of the driving lever in order to prevent the brake head from making contact with the pivot extension which remains positioned behind the brake head.

15. The brake rigging according to claim 12, wherein each support pivot includes a bushing element on which is mounted the second end of a corresponding driving lever, and each brake head is directly linked to a central portion of each driving lever by a fastener passing through a perforation located at a central portion intermediate the first and second ends of each driving lever and through a perforation on the brake head, the brake rigging further comprising a clasp for retaining each bushing element on the bogie of the railway car at one of the support points.

* * * * *